US006055747A

United States Patent [19]

Lombardino

[11] Patent Number: 6,055,747

[45] Date of Patent: May 2, 2000

[54] SHOCK ABSORPTION AND ENERGY RETURN ASSEMBLY FOR SHOES

[76] Inventor: Thomas D. Lombardino, 82-11 160th Ave., Howard Beach, N.Y. 11414

[21] Appl. No.: 09/303,087

[22] Filed: Apr. 29, 1999

[51] Int. Cl.[7] ..... A43B 21/32

[52] U.S. Cl. ..... 36/37; 36/38; 36/27; 36/28

[58] Field of Search ..... 36/27, 28, 29, 36/37, 38

[56] References Cited

U.S. PATENT DOCUMENTS

| | | | |
|---|---|---|---|
| 2,669,038 | 2/1954 | De Werth | 36/27 |
| 5,224,278 | 7/1993 | Jeon | 36/27 |
| 5,502,901 | 4/1996 | Brown | 36/28 |
| 5,649,374 | 7/1997 | Chou | 36/27 |
| 5,743,028 | 4/1998 | Lombardino | 36/27 |

*Primary Examiner*—M. D. Patterson
*Attorney, Agent, or Firm*—Michael S. Neustel

[57] ABSTRACT

A shock absorption and energy return assembly for increasing the overall performance of a shoe by increasing the stability and shock absorption of the heel. The inventive device includes a lower guide member having a plurality of lower apertures and lower spring retainers, an upper guide member having a plurality of upper apertures and upper spring retainers, a plurality of compression springs positioned within the lower spring retainers and the upper spring retainers, a sealed encasement having a lower portion and an upper portion surrounding the lower guide member and the upper guide member, and a plurality of lower extrusions and upper extrusions. The lower guide member and the upper guide member are preferably U-shaped. The plurality of compression springs are aligned within the perimeter of the lower guide member and the upper guide member for providing maximum stability and response for the user. The encasement is preferably filled with a pressurized gas for adding stability and dampening of the compression springs. The inventive device is designed to be inserted or molded within the heel portion of the mid-sole of a shoe. The encasement is preferably constructed of a transparent or semi-transparent material utilized in combination with a cutout within the mid-sole thereby allowing individuals to view the inventive device in operation.

13 Claims, 5 Drawing Sheets

16
20
12
14
50

40
28
26
20
50
30
24
22

50
4
4
20
14
40
42
44

16
28
44
40
26
20
50
30
22
34
24
12
14

16
26
28
40
20
50
30
22
24
12
14

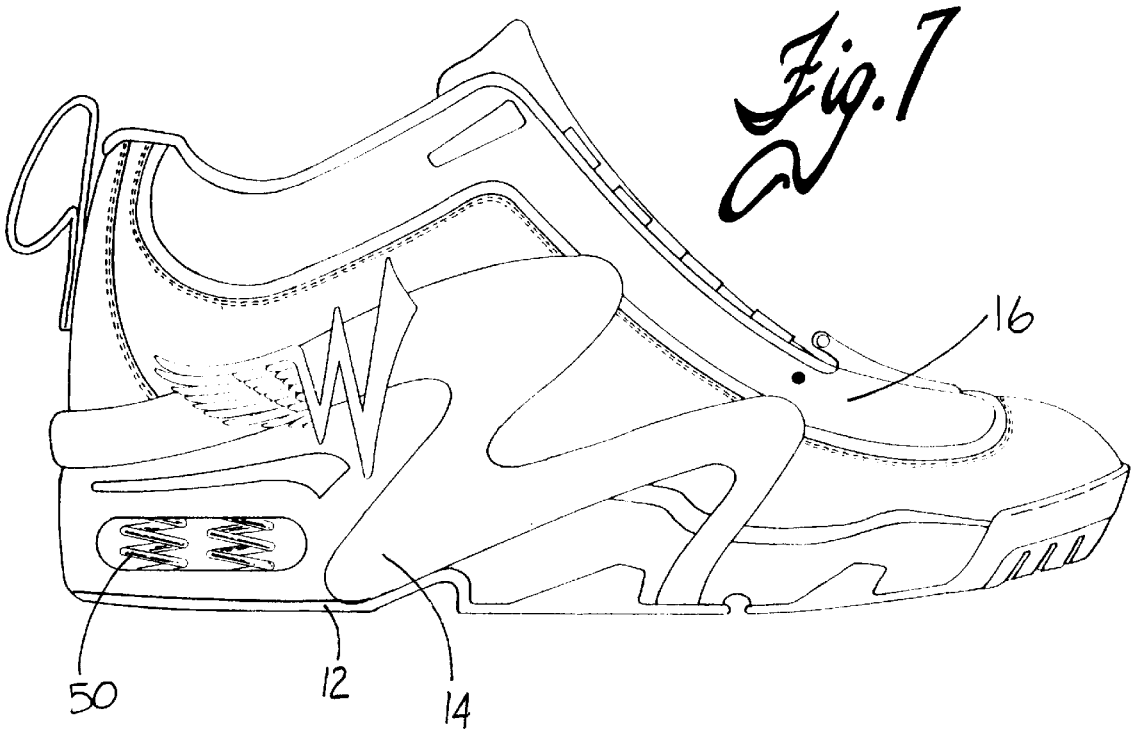
Fig. 7
Fig. 8
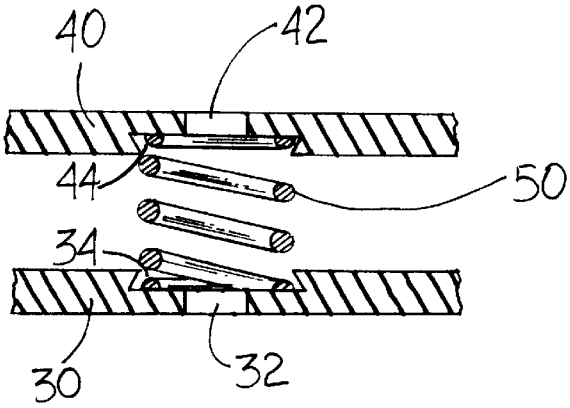

SHOCK ABSORPTION AND ENERGY RETURN ASSEMBLY FOR SHOES

BACKGROUND OF THE INVENTION

1. Field of the Invention

The present invention relates generally to footwear cushion devices and more specifically it relates to a shock absorption and energy return assembly for increasing the overall performance of a shoe by increasing the stability and shock absorption of the heel.

Footwear, such as athletic shoes, are utilized by millions of individuals throughout the world. Athletic shoes are utilized in sports such as basketball, soccer, baseball, volleyball, track and football. When utilized in extreme environments such as athletic shoes are often utilized in, the heel portion of the shoe is constantly engaging the surface of play. This causes significant stress upon the user's heel bone and joints within their entire body eventually leading to serious injury to the user. Hence, there is a need for a shoe that reduces the amount of shock to the heel and which displaces the impact throughout the entire heel area.

2. Description of the Prior Art

Footwear cushion devices have been in use for years. Typically, footwear includes a rubber sole, a mid-sole attached to the rubber sole, and an upper. The upper is generally constructed of leather or similar material. The mid-sole is generally constructed of a resilient foamed polyurethane type material for cushioning the user's foot during use. The mid-sole, particularly in the rear portion, will often times have a reticulated structure for providing increased flexibility and resilience. Some brands of footwear include a pressurized bag located in the heel portion for providing increased cushioning during utilization.

These designs of footwear do not provide the desired amount of cushioning and stability required for a high performance athletic shoe. In addition, conventional footwear do not provide an energy return system for increasing the overall efficiency of the shoe.

While these devices may be suitable for the particular purpose to which they address, they are not as suitable for increasing the overall performance of a shoe by increasing the stability and shock absorption of the heel. Conventional footwear devices do not provide the required amount of shock absorption for the heel. In addition, conventional footwear devices do not provide an energy return system for increasing the overall efficiency of the footwear.

In these respects, the shock absorption and energy return assembly for shoes according to the present invention substantially departs from the conventional concepts and designs of the prior art, and in so doing provides an apparatus primarily developed for the purpose of increasing the overall performance of a shoe by increasing the stability and shock absorption of the heel.

SUMMARY OF THE INVENTION

In view of the foregoing disadvantages inherent in the known types of footwear cushion devices now present in the prior art, the present invention provides a new shock absorption and energy return assembly for shoes construction wherein the same can be utilized for increasing the overall performance of a shoe by increasing the stability and shock absorption of the heel.

The general purpose of the present invention, which will be described subsequently in greater detail, is to provide a new shock absorption and energy return assembly for shoes that has many of the advantages of the footwear cushion devices mentioned heretofore and many novel features that result in a new shock absorption and energy return assembly for shoes which is not anticipated, rendered obvious, suggested, or even implied by any of the prior art footwear cushion devices, either alone or in any combination thereof.

To attain this, the present invention generally comprises a lower guide member having a plurality of lower apertures and lower spring retainers, an upper guide member having a plurality of upper apertures and upper spring retainers, a plurality of compression springs positioned within the lower spring retainers and the upper spring retainers, a sealed encasement having a lower portion and an upper portion surrounding the lower guide member and the upper guide member, and a plurality of lower extrusions and upper extrusions. The lower guide member and the upper guide member are preferably U-shaped. The plurality of compression springs are aligned within the perimeter of the lower guide member and the upper guide member for providing maximum stability and response for the user. The encasement is preferably filled with a pressurized gas for adding stability and dampening of the compression springs. The inventive device is designed to be inserted or molded within the heel portion of the mid-sole of a shoe. The encasement is preferably constructed of a transparent or semi-transparent material utilized in combination with a cutout within the mid-sole thereby allowing individuals to view the inventive device in operation.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a shock absorption and energy return assembly for shoes that will overcome the shortcomings of the prior art devices.

Another object is to provide a shock absorption and energy return assembly for shoes that absorbs a substantial amount of the force incurred by the heel of the shoe.

An additional object is to provide a shock absorption and energy return assembly for shoes that efficiently receives and releases forces incurred by the heel of the shoe.

A further object is to provide a shock absorption and energy return assembly for shoes that provides significant lateral stability to the shoe.

Another object is to provide a shock absorption and energy return assembly for shoes that can be manufactured into a singular enclosed unit.

A further object is to provide a shock absorption and energy return assembly for shoes that utilizes compression springs for receiving and releasing energy from and into the shoe.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein:

FIG. 7 is an alternative embodiment of the present invention within the mid-sole of a shoe without the sealed encasement.

FIG. 8 is a cross sectional view of the spring housing taken along line 4—4 of FIG. 3 better illustrating the spring retainers of the upper and lower guide members.

DESCRIPTION OF THE PREFERRED EMBODIMENT

Figure 1:
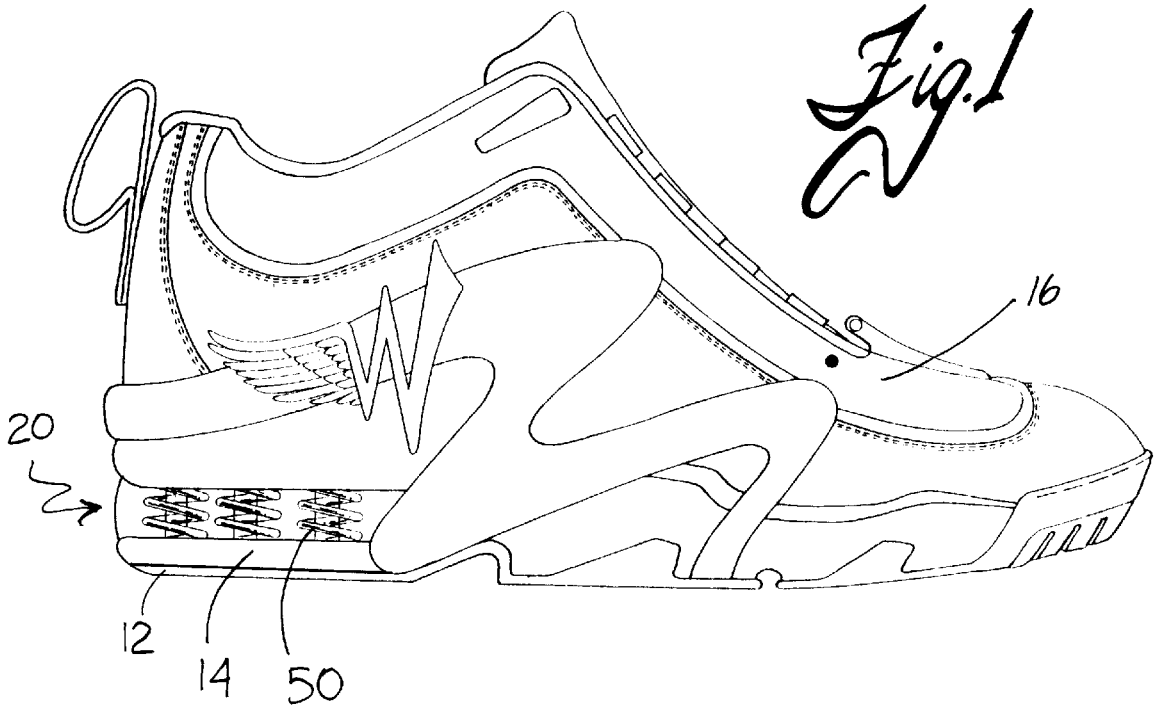
FIG. 1 is a side view of the present invention within a shoe.
Figure 2:
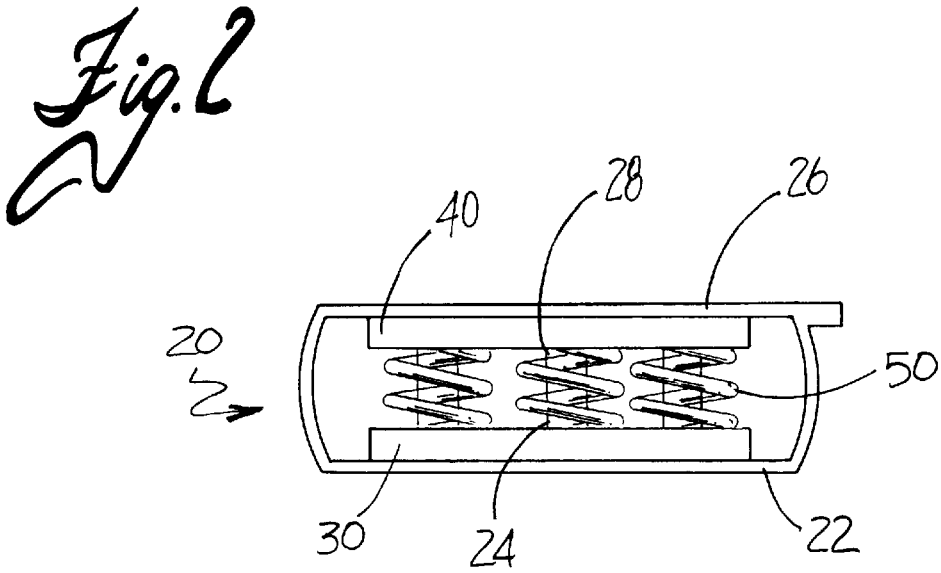
FIG. 2 is a side view of the present invention.

Turning now descriptively to the drawings, in which similar reference characters denote similar elements throughout the several view, FIGS. 1 through 8 illustrate a shock absorption and energy return assembly for shoes 10, which comprises a lower guide member 30 having a plurality of lower apertures 32 and lower spring retainers 34, an upper guide member 40 having a plurality of upper apertures 42 and upper spring retainers 44, a plurality of compression springs 50 positioned within the lower spring retainers 34 and the upper spring retainers 44, a sealed encasement 20 having a lower portion 22 and an upper portion 26 surrounding the lower guide member 30 and the upper guide member 40, and a plurality of lower extrusions 24 and upper extrusions 28. The lower guide member 30 and the upper guide member 40 are preferably U-shaped. The plurality of compression springs 50 are aligned within the perimeter of the lower guide member 30 and the upper guide member 40 for providing maximum stability and response for the user. The encasement 20 is preferably filled with a pressurized gas for adding stability and dampening of the compression springs 50. The inventive device is designed to be inserted or molded within the heel portion of the mid-sole 14 of a shoe. The encasement 20 is preferably constructed of a transparent or semi-transparent material utilized in combination with a cutout within the mid-sole 14 thereby allowing individuals to view the inventive device in operation.

Conventional shoes generally comprise a lower sole 12, a mid-sole 14 and an upper. The lower sole 12 is generally constructed of a rubber material and has a gripping portion on the lower surface of the lower sole 12. The mid-sole 14 is attached to the lower sole 12 by stitching or adhesive and is generally constructed of a resilient foam rubber material. The upper is generally constructed of leather or synthetic leather material.

Figure 6:
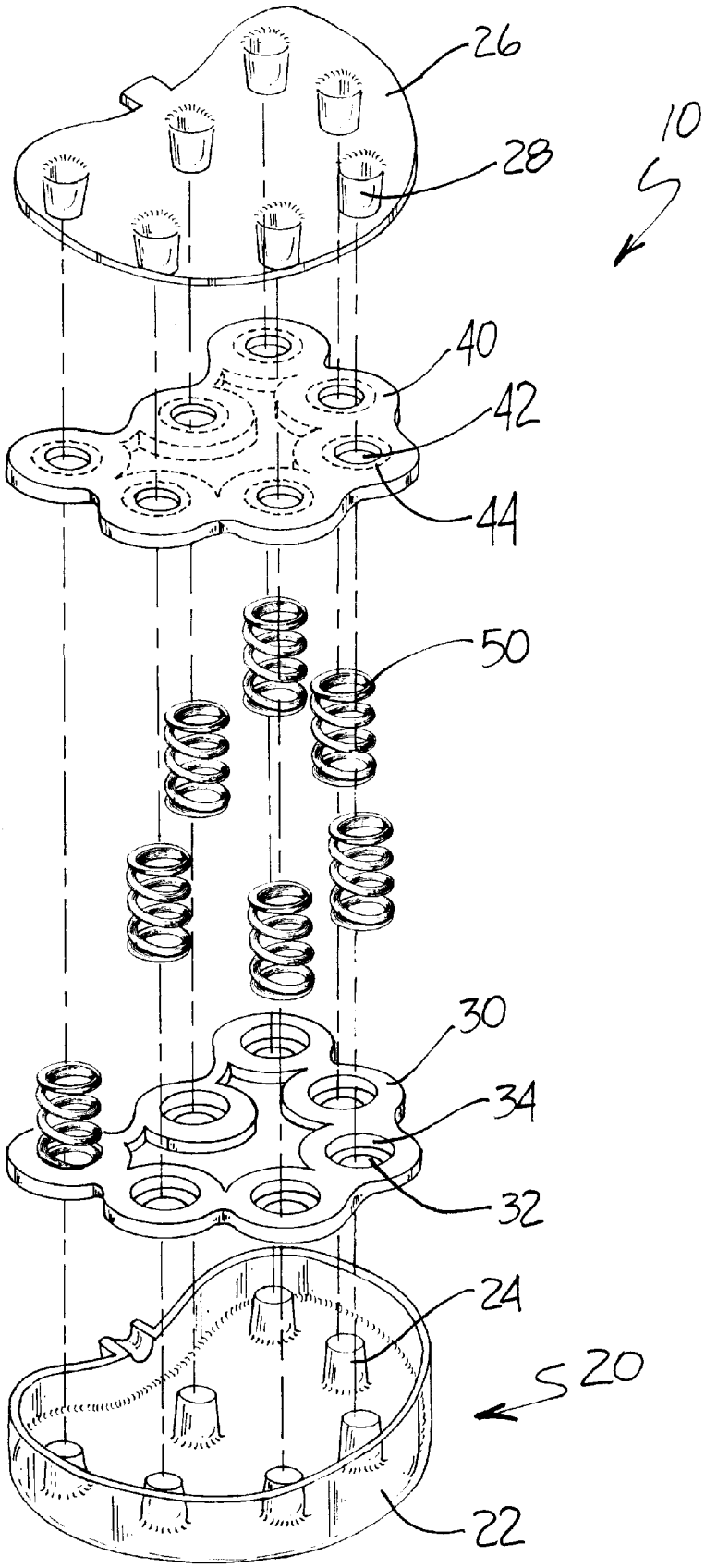
FIG. 6 is an exploded upper perspective view of the present invention.

As best shown in FIG. 6 of the drawings, the encasement 20 is preferably comprised of a substantially U-shaped structure for fitting within the heel portion of the mid-sole 14. The encasement 20 is preferably constructed of a resilient transparent or semi-transparent material. The encasement 20 is preferably constructed of a sealed and impermeable polyurethane material.

Figure 3:
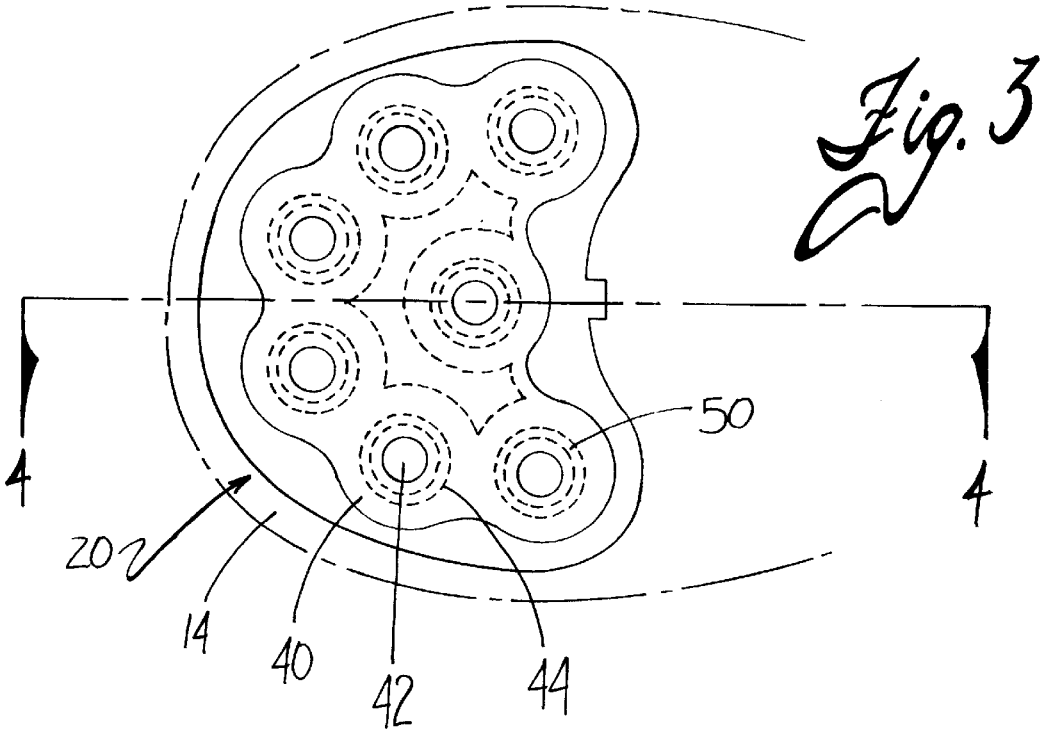
FIG. 3 is a top view of the present invention.

As best shown in FIG. 6, the encasement 20 is preferably comprised of a lower portion 22 and an upper portion 26. The lower portion 22 of the encasement 20 has a floor and a side wall surrounding the entire perimeter of the floor. The floor preferably has a U-shape as shown in FIGS. 3 and 7 of the drawings.

As best shown in FIG. 6 of the drawings, the upper portion 26 is generally a flat structure that is shaped substantially the same as the floor of the lower portion 22. The perimeter of the upper portion 26 is attached and sealed to the upper portion 26 of the side wall of the lower portion 22 as shown in FIG. 6 of the drawings. The upper portion 26 may be sealed with the lower portion 22 by any well-known means such as hermetically sealing process or chemical sealing.

If desired, a pressurized gas may be inserted into the sealed encasement 20 for providing increased stability and absorption in combination with the plurality of compression springs 50. The pressurized gas is comprised of an inert gas such as Argon or Krypton. The pressurized gas may have a pressure of 0–25 psi depending the designed use of the shoe. The more pressure within the sealed encasement 20 the more dampening and shock absorption received within the shoe. The less pressure within the sealed encasement 20 the compression spring contract and expand further thereby providing more energy return to the user.

As best shown in FIG. 6 of the drawings, a plurality of lower extrusions 24 extend from the floor of the lower portion 22. The lower extrusions 24 extend upwardly near the side wall of the lower portion 22 for inserting through the lower guide member 30 and the plurality of compression springs 50. The lower extrusions 24 preferably have a slight taper from the floor of the lower portion 22. The lower extrusions 24 are preferably molded within the floor of the lower portion 22, however it can be appreciated that they can be attached to the floor. The lower extrusions 24 are preferably less than half the length of the compression springs 50.

As further shown in FIG. 6 of the drawings, a plurality of upper extrusions 28 extend from the upper portion 26. The upper extrusions 28 extend downwardly from the upper portion 26 for inserting through the upper guide member 40 and the plurality of compression springs 50. The upper extrusions 28 preferably have a slight taper as best shown in FIG. 7 of the drawings. The upper extrusions 28 are preferably molded within the upper portion 26, however it can be appreciated that they can be attached to the upper portion 26 after being molded. The upper extrusions 28 are preferably less than half the length of the compression springs 50 for preventing engagement with the lower extrusions 24 of the lower portion 22.

As best shown in FIG. 6 of the drawings, a lower guide member 30 is formed to fit within the side wall of the lower portion 22. The lower guide member 30 is preferably U-shaped similar to the floor of the lower portion 22. The lower guide member 30 preferably includes a plurality of lower apertures 32 that receive the lower extrusions 24.

The lower apertures 32 are preferably aligned within the outer perimeter of the lower guide member 30 as shown in FIG. 6. As further shown in FIG. 6 of the drawings, a corresponding plurality of lower spring retainers 34 are positioned within the lower apertures 32 for receiving lower section of the plurality of compression springs 50.

As best shown in FIG. 6 of the drawings, an upper guide member 40 is formed to fit within the side wall of the lower portion 22. The upper guide member 40 is preferably U-shaped similar to the upper portion 26. The upper guide member 40 preferably includes a plurality of upper apertures 42 that receive the upper extrusions 28.

The upper apertures 42 are preferably aligned within the outer perimeter of the upper guide member 40 as shown in FIG. 6. As further shown in FIG. 6 of the drawings, a corresponding plurality of upper spring retainers 44 are positioned within the upper apertures 42 for receiving upper section of the plurality of compression springs 50.

Figure 4:
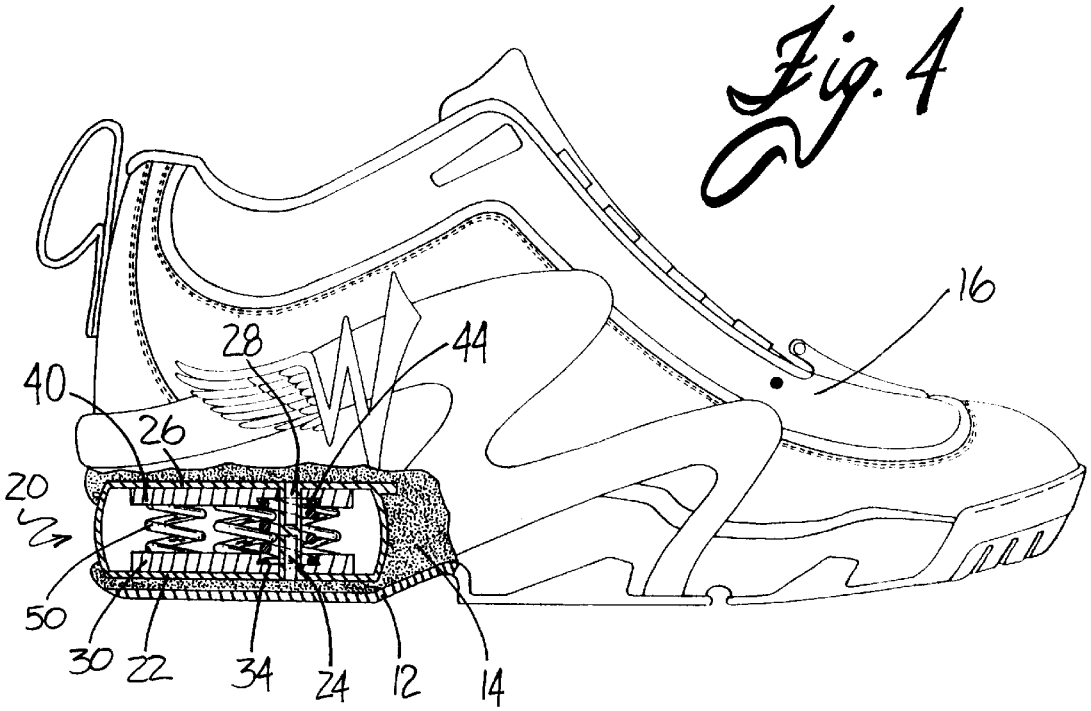
FIG. 4 is a cross sectional view taken along line 4—4 of FIG. 3.
Figure 5:
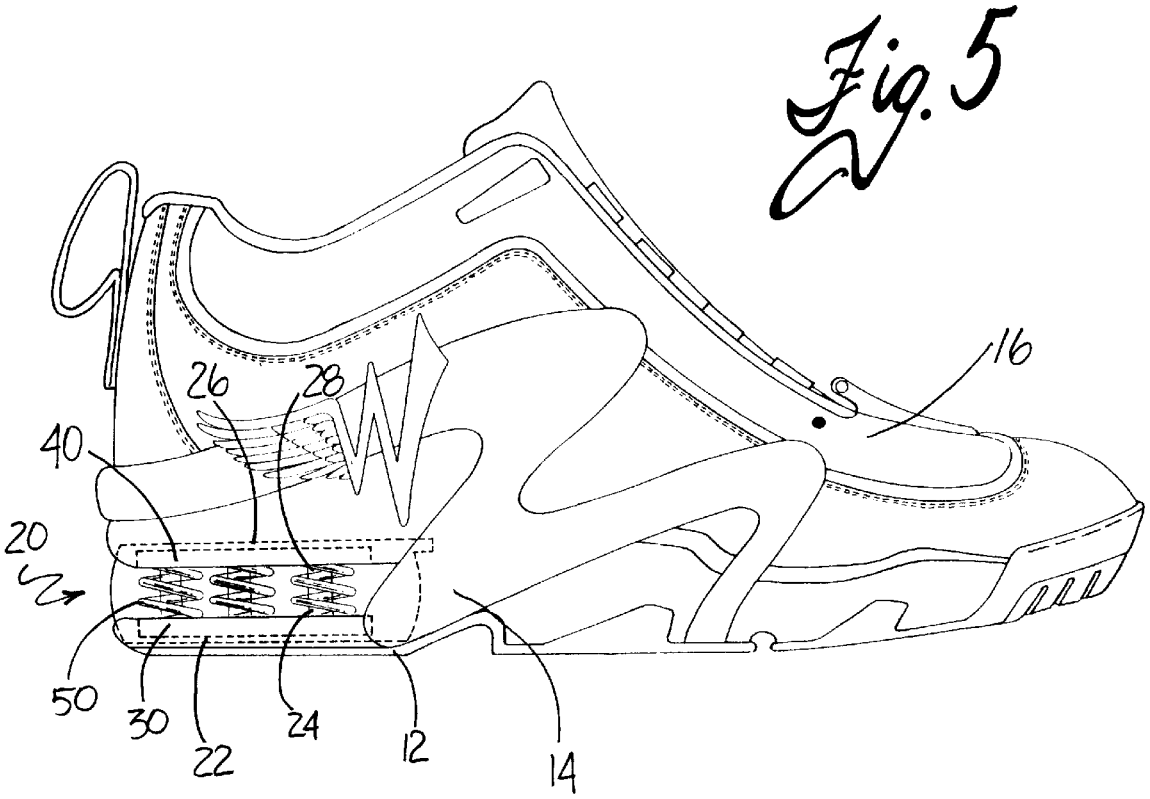
FIG. 5 is a side view of the present invention within a shoe.

As best shown in FIGS. 1, 2, 4 and 5 of the drawings, the plurality of compression springs 50 are retained between the lower guide member 30 and the upper guide member 40. The compression springs 50 are retained within the spring retainers 34, 44 as shown in FIG. 4 of the drawings. The compression springs 50 may be constructed of any well-known material or gauge of metal.

In an alternative embodiment shown in FIG. 7 of the drawings, the inventive device can be constructed without the sealed encasement 20. As shown in FIG. 7, the same structure would be utilized and retained within the heel portion of the mid-sole 14 without the sealed encasement 20 thereby decreasing the overall expense of the inventive device.

In use, the user positions their foot within each shoe. When the user steps, the heel generally receives the initial shock of the user's body weight. The heel of the user's foot presses against the heel portion of the mid-sole 14 thereby contracting the compression springs 50 and the sealed encasement 20. As the sealed encasement 20 is depressed, the gas pressure within the sealed encasement 20 rises significantly thereby resulting in an opposite force to lift the heel of the user's foot. Simultaneously, the compression springs 50 expand thereby forcing the upper guide member 40 and mid-sole 14 upwardly thereby returning the energy received from the heel of the foot during running or walking. This process is repeated many times for each individual shoe until the user removes the shoes.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shock absorption and energy return assembly for shoes comprising:

a lower guide member having a plurality of spring retainer cavities;

an upper guide member having a plurality of spring retainer cavities;

a plurality of springs positioned between said lower guide member and said upper guide member;

an encasement having an upper portion and a lower portion surrounding said lower guide member and said upper guide member; and said encasement includes a plurality of extrusions extending from said lower portion and a plurality of extrusions extending from said upper portion; and said lower guide member includes a plurality of apertures within said spring retainer cavities and said upper guide member includes a plurality of apertures within said spring retainer cavities, wherein said apertures receive said extrusions whereafter the extrusions extend into said plurality of compression springs.

2. The shock absorption and energy return assembly for shoes of claim 1, wherein said upper and lower spring retainer cavities are tapered inwardly at an outer rim for providing a more substantial means of holding said compression springs.

3. The shock absorption and energy return assembly for shoes of claim 1, wherein said encasement is comprised of a resilient material.

4. The shock absorption and energy return assembly for shoes of claim 1, wherein said encasement is comprised of a transparent material.

5. The shock absorption and energy return assembly for shoes of claim 1, wherein said encasement is sealed and has a pressurized gas at a pressure greater than 0 psi.

6. A shock absorption and energy return assembly for shoes, comprising:

a lower guide member;

an upper guide member;

a plurality of springs positioned between said lower guide member and said upper guide member;

an encasement having an upper portion and a lower portion surrounding said lower guide member and said upper guide member; and said encasement includes a plurality of extrusions extending from said lower portion and a plurality of extrusions extending from said upper portion; and said lower guide member includes a plurality of apertures and said upper guide member includes a plurality of apertures, wherein said apertures receive said extrusions whereafter the extrusions extend into said plurality of compression springs.

7. The shock absorption and energy return assembly for shoes of claim 6, wherein said encasement is comprised of a resilient material.

8. The shock absorption and energy return assembly for shoes of claim 6, wherein said encasement is comprised of a transparent material.

9. The shock absorption and energy return assembly for shoes of claim 6, wherein said encasement is sealed and has a pressurized gas at a pressure greater than 0 psi.

10. A shock absorption and energy return assembly for shoes, comprising:

a lower guide member;

an upper guide member;

a plurality of springs positioned between said lower guide member and said upper guide member;

an encasement having an upper portion and a lower portion surrounding said lower guide member and said upper guide member; and said encasement includes a plurality of extrusions extending into an interior of said encasement; and said lower guide member includes a plurality of apertures and said upper guide member includes a plurality of apertures, wherein said apertures receive said extrusions whereafter the extrusions extend into said plurality of compression springs.

11. The shock absorption and energy return assembly for shoes of claim 10, wherein said encasement is comprised of a resilient material.

12. The shock absorption and energy return assembly for shoes of claim 10, wherein said encasement is comprised of a transparent material.

13. The shock absorption and energy return assembly for shoes of claim 10, wherein said encasement is sealed and has a pressurized gas at a pressure greater than 0 psi.

* * * * *